US007131427B2

(12) United States Patent
Kawasaki et al.

(10) Patent No.: US 7,131,427 B2
(45) Date of Patent: Nov. 7, 2006

(54) FUEL INJECTION DEVICE HAVING TWO SEPARATE COMMON RAILS

(75) Inventors: Yusuke Kawasaki, Kariya (JP); Ryo Suenaga, Kariya (JP); Mamoru Oki, Chiyu (JP)

(73) Assignee: Denso Corporation (JP)

( * ) Notice: Subject to any disclaimer, the term of this patent is extended or adjusted under 35 U.S.C. 154(b) by 57 days.

(21) Appl. No.: 10/986,277

(22) Filed: Nov. 12, 2004

(65) Prior Publication Data

US 2005/0115545 A1 Jun. 2, 2005

(30) Foreign Application Priority Data

Nov. 28, 2003 (JP) ..... 2003-399976

(51) Int. Cl.
*F02M 69/46* (2006.01)
*F02M 55/02* (2006.01)

(52) U.S. Cl. ..... 123/456; 123/468

(58) Field of Classification Search ..... 123/456, 123/467, 468, 469

See application file for complete search history.

(56) References Cited

U.S. PATENT DOCUMENTS 4,586,477 A * 5/1986 Field et al. ..... 123/468
5,002,030 A * 3/1991 Mahnke ..... 123/469
5,056,489 A * 10/1991 Lorraine ..... 123/468
5,390,638 A * 2/1995 Hornby et al. ..... 123/456
5,445,130 A * 8/1995 Brummer et al. ..... 123/456
5,511,527 A * 4/1996 Lorraine et al. ..... 123/456
6,401,691 B1 * 6/2002 Kawano et al. ..... 123/456
6,928,984 B1 * 8/2005 Shamine et al. ..... 123/456
6,935,315 B1 * 8/2005 Seymour, II ..... 123/456

FOREIGN PATENT DOCUMENTS

EP 0995902 A2 4/2000
EP 1188919 A2 3/2002
WO WO 03/008796 A1 1/2003

OTHER PUBLICATIONS

Anisitis, Ferenc et al. Der erste Achtzylinder-Dieselmotor mit Direktienspritzung von BMW, Motorechnische Zeitschrift (MTZ) (1999), eight (8) pages.
Anisits et al., "Der erste Achtzylinder-Diesel-motor mit Direkteinspritzung von BMW", 1999, and English translation.
French Search Report—Dec. 16, 2005.

* cited by examiner

*Primary Examiner*—Thomas Moulis
(74) *Attorney, Agent, or Firm*—Nixon & Vanderhye PC

(57) ABSTRACT

A fuel injection device for supplying high-pressure fuel to an internal combustion engine includes a fuel supply pump, a first common rail and a second common rail. High-pressure fuel is directly supplied to the first common rail and then to the second common rail from the first common rail through a connecting passage having an orifice. The high-pressure fuel accumulated in the common rails is supplied to injectors and is injected into cylinders in a controlled manner. To suppress pressure wave propagation from the first common rail to the second common rail while providing an appropriate flow passage size, a passage diameter of the orifice is set to 0.9 mm–1.3 mm. In this manner, a pressure difference between the first common rail and the second common rail is minimized.

10 Claims, 5 Drawing Sheets

FUEL INJECTION DEVICE HAVING TWO SEPARATE COMMON RAILS

CROSS-REFERENCE TO RELATED APPLICATION

This application is based upon and claims benefit of priority of Japanese Patent Application No. 2003-399976 filed on Nov. 28, 2003, the content of which is incorporated herein by reference.

BACKGROUND OF THE INVENTION

1. Field of the Invention

The present invention relates to a common-rail-type fuel injection device having two separate common rails for supplying high-pressure fuel to an internal combustion engine.

2. Description of Related Art

A common-rail-type fuel injection device having two separate common rails is often used for an internal combustion engine having two cylinder lines, such as a V-type engine or a parallel-facing-type engine. This type of fuel injection device is described, e.g., in an article entitled "Der erste Achtzylinder-Dieselmotor mit Direkteinspritzung von BMW" (authors: Ferenc Anisits, Klaus B. Borgmann, Helmut Kratochwill and Fritz Steinparzer) in "Motortechnische Zeitschrift (MTZ)" issued in 1999. A relevant portion of the injection device is shown in FIG. 5 attached hereto.

In this fuel injection device, high-pressure fuel is supplied from a fuel supply pump J1 to a distributing block J2, and then the high-pressure fuel is distributed to a first common rail J3 and to a second common rail J4. The high-pressure fuel is injected into cylinders of a first block from each injector J5 connected to the first common rail J3. Similarly, the high-pressure fuel is injected into cylinders of a second block from each injector J6 connected to the second common rail J4. The distributing block J2 functions to distribute the high-pressure fuel to two common rails separately disposed.

It is conceivable to eliminate the distributing block J2 and to connect the first common rail J3 and the second common rail J4 in series. In this arrangement, the high-pressure fuel is directly supplied to the first common rail J3 from the fuel supply pump J1 and then to the second common rail J4 from the first common rail J3. If this arrangement successfully works, the distributing block J2 can be eliminated and the device is simplified as a whole. However, pressure waves are generated between the first common rail J3 and the second common rail J4 by connecting both common rails with a connecting passage. The pressure waves are caused by a pulsating pressure in the fuel supply pump J1 and fuel injection from the injectors J5, J6. A pressure difference between two common rails J3 and J4 is caused by the influence of the pressure waves. Therefore, a problem that an injection pressure differs between the first group of injectors J5 and the second group of injectors J6 occurs. The injection pressure difference results in a difference in an injection amount.

SUMMARY OF THE INVENTION

The present invention has been made in view of the above-mentioned problem, and an object of the present invention is to provide an improved common-rail-type fuel injection device having two separate common rails, wherein a pressure difference between two common rails is suppressed without using a distributing block.

The common-rail-type fuel injection device is used for supplying high-pressure fuel to an internal combustion engine such as a diesel engine. The device includes a first common rail, a second common rail, and a fuel supply pump for supplying high-pressure fuel to the common rails. The first common rail accumulates therein the high-pressure fuel supplied from the fuel supply pump and supplies the accumulated high-pressure fuel to first injectors connected thereto. Similarly, the second common rail accumulates therein the high-pressure fuel supplied from the fuel supply pump and supplies the accumulated high-pressure fuel to second injectors connected thereto. Injection timing of the injectors and an amount of fuel injected into each cylinder of the engine are controlled by an electronic control unit.

The fuel supply pump is directly connected to the first common rail, and the first common rail is connected to the second common rail through a connecting passage. That is, the fuel supply pump, the first common rail and the second common rail are connected in series. An orifice having a passage diameter in a range from 0.9 mm–1.3 mm, (more preferably, 1.0 mm–1.1 mm) is disposed in the connecting passage to suppress or eliminate a pressure difference between the first common rail and the second common rail. High-pressure fuel is supplied to the first common rail and then to the second common rail through the connecting passage having the orifice.

Since the passage diameter in the orifice is set to an optimum size for suppressing or attenuating pressure wave propagation from the first common rail to the second common rail and for securing an appropriate flow passage without excessively increasing a flow resistance, a pressure difference between the first common rail and the second common rail is minimized. Therefore, differences in injection pressure and injection amount between the first injectors and the second injectors are also minimized. This is attained without using the conventional distributing block. Accordingly, the manufacturing cost of the injection device is lowered, and the injection device is easily mounted on the engine.

The orifice may be integrally formed with either the first common rail or the second common rail, or with both common rails. By forming the orifice integrally with the common rail, the number of components used in the injection device can be decreased. Alternatively, the orifice maybe disposed in a middle of the connecting passage. The passage diameter of the orifice may be made variable so that it is controlled according to operational conditions of the engine.

Other objects and features of the present invention will become more readily apparent from a better understanding of the preferred embodiments described below with reference to the following drawings.

DETAILED DESCRIPTION OF THE PREFERRED EMBODIMENTS

Figure 1:
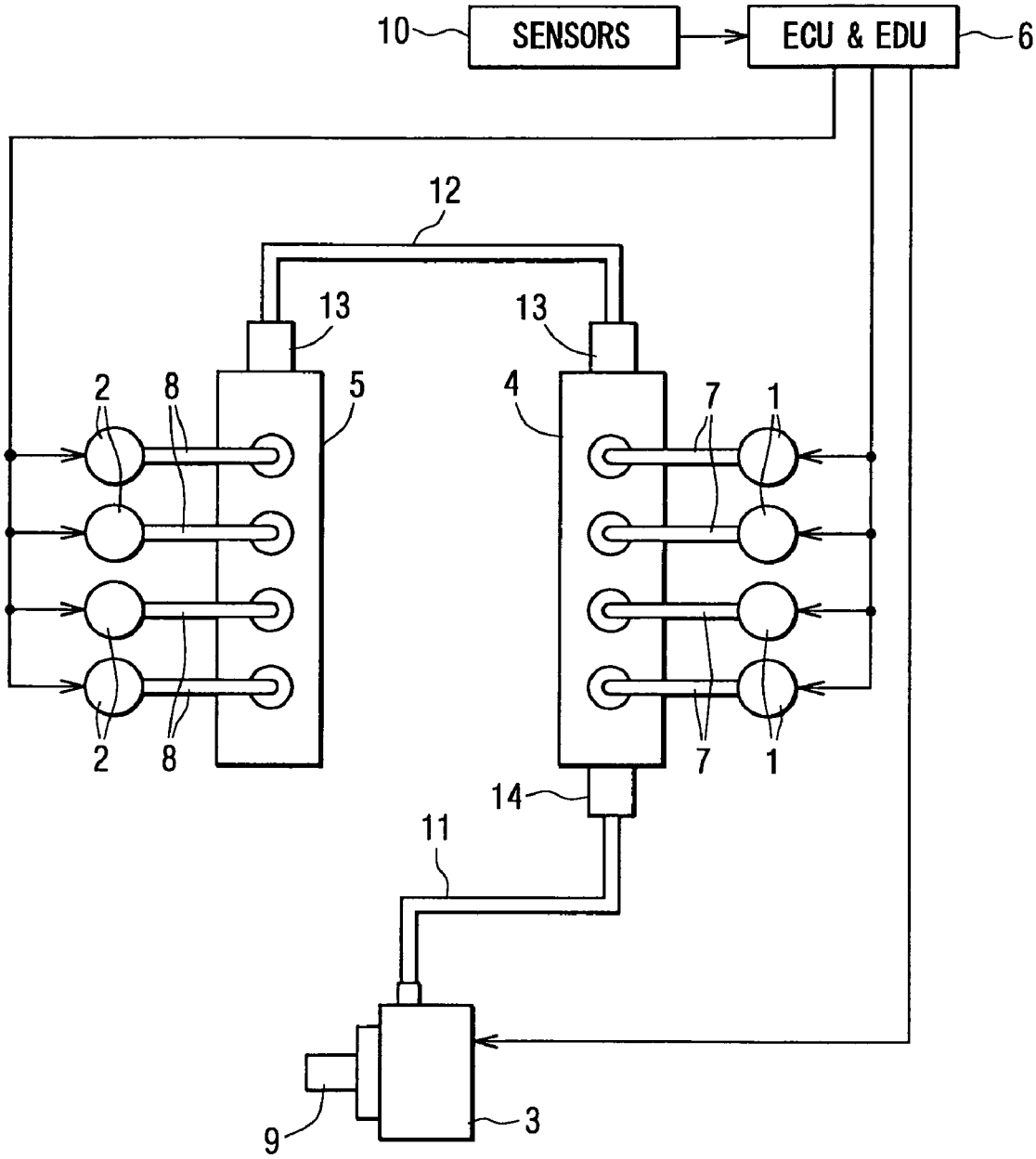
FIG. 1 is a block diagram briefly showing a common-rail-type fuel injection device as a first embodiment of the present invention.

A first embodiment of the present invention will be described with reference to FIGS. 1–3B. A common-rail-type injection device shown in FIG. 1 is used for an eight-cylinder diesel engine having two lines (two blocks) of cylinders, such as a V-type engine and a parallel-facing-type engine. The fuel injection device is composed of a fuel supply pump 3, a first common rail 4 to which first injectors 1 are connected, a second common rail 5 to which second injectors 2 are connected, an electronic control unit and an electronic drive unit 6, and associated components.

The first injectors 1 are mounted on a first cylinder line (block) having four cylinders and connected to the first common rail 4 through injector pipes 7. Each first injector 1 injects high-pressure fuel accumulated in the first common rail 4 into each cylinder of the first cylinder line. Similarly, the second injectors 2 are mounted on a second cylinder line (block) having four cylinders and connected to the second common rail 5 through injector pipes B. Each second injector 2 injects high-pressure fuel accumulated in the second common rail 5 into each cylinder of the second cylinder line.

The fuel supply pump 3 is composed of a feed pump (a low pressure pump) for sucking fuel from a fuel tank and a high-pressure pump for pressurizing the sucked fuel to a high pressure. The feed pump and the high-pressure pump are driven by a common camshaft 9 that is driven by a crankshaft of the engine. The pressurized fuel is supplied to the first common rail 4 through a connecting pipe 11 connected to a connecting port 14 of the first common rail 4. The fuel supply pump 3 includes a control valve for controlling an amount of fuel sucked into the fuel supply pump 3. The control valve is controlled by the control unit 6, and thereby the amount of fuel supplied from the fuel supply pump 3 to the first common rail 4 is controlled. Thus, the pressure in the common rail is adjusted or controlled.

For example, the fuel supply pump 3 is a pump having three plungers positioned at a 120-degree interval. Each plunger delivers pressurized fuel one time per one rotation of the camshaft 9. A rotational speed of the crankshaft is reduced by a speed-reducing device and transmitted to the camshaft 9 thereby to rotate the camshaft 9 at two-thirds of the rotational speed of the crankshaft. As a result, the fuel supply pump 3 delivers the pressurized fuel four times every 2-rotation of the crankshaft. Eight injections (one injection from each injector) are performed during four-time delivery of the pressurized fuel.

The control unit 6 includes an electronic control unit (ECU) for performing various calculations and an electronic drive unit (EDU) for controlling power supply to the injectors 1, 2 and a control valve in the fuel supply pump 3. The ECU and the EDU may be contained in a common box or both may be contained in separate containers. The ECU is a known microcomputer that includes a central processing unit (CPU), various memories (such as ROM, standby RAM, and RAM), an input/output circuit, etc. The ECU performs various controls such as injection timing of the injectors 1, 2 and opening degree of the valve in the fuel supply pump 3 based on various information fed from sensors 10. The information fed from the sensors 10 include engine parameters, operating conditions of the engine and driving conditions of the vehicle. The sensors 10 include a sensor for detecting an opening degree of a throttle valve, a sensor for detecting rotational speed of the engine, a sensor for detecting engine coolant temperature, a sensor for detecting pressure in the common rails, a sensor for detecting a fuel temperature, and so on.

The first common rail 4 is mounted on a cylinder block having a first line of cylinders. Pressurized fuel fed from the fuel supply pump 3 is accumulated in the first common rail 4, and the accumulated fuel is supplied to the first injectors 1. Similarly, the second common rail 5 is mounted on a cylinder block having a second line of cylinders. Pressurized fuel fed from the fuel supply pump 3 through the first common rail 4 is accumulated in the second common rail 5, and the accumulated fuel is supplied to the second injectors 2. The fuel supply pump 3 is connected to the first common rail 4 through a connecting pipe 11 which is connected to a connecting port 14 of the first common rail 4. The first common rail 4 and the second common rail 5 are connected through a connecting passage 12. Fuel pressurized in the fuel supply pump 3 is first fed to the first common rail 4 and then to the second common rail 5 through the connecting passage 12. In other words, the fuel supply pump 3, the first common rail 4 and the second common rail 5 are connected in series.

In the system in which the first and the second common rails 4, 5 are connected in series, a pressure wave due to pressure pulsations in the fuel pressurized in the fuel supply pump 3 and pressure pulsations caused by the fuel injection is generated between the first common rail 4 and the second common rail 5. Under influence of this pressure wave, there occurs a pressure difference between the first and the second common rails 4, 5. The pressure difference in turn causes differences in injection pressure and in injection amount between the first injectors 1 and the second injectors 2. To suppress propagation of the pressure wave and to attenuate the pressure wave, a pair of orifices 13 is disposed in the connecting passage 12 in this embodiment. In place of the pair of orifices 13, a single orifice 13 may be disposed in the connecting passage 12.

In order to effectively reduce or eliminate the pressure difference between the common rails 4, 5, irrespective of operational conditions of the engine, a passage diameter in the orifice 13 has to be carefully determined. The pressure wave propagation is interrupted and the pressure wave is attenuated by making the passage diameter small. If the diameter is too small, however, a flow resistance in the orifice becomes high. Accordingly, a pressure difference is generated between an upstream portion and a downstream portion of the orifice 13 when an amount of fuel flow per unit of time becomes large. This generates the pressure difference between the first common rail 4 and the second common rail 5.

Figure 2:
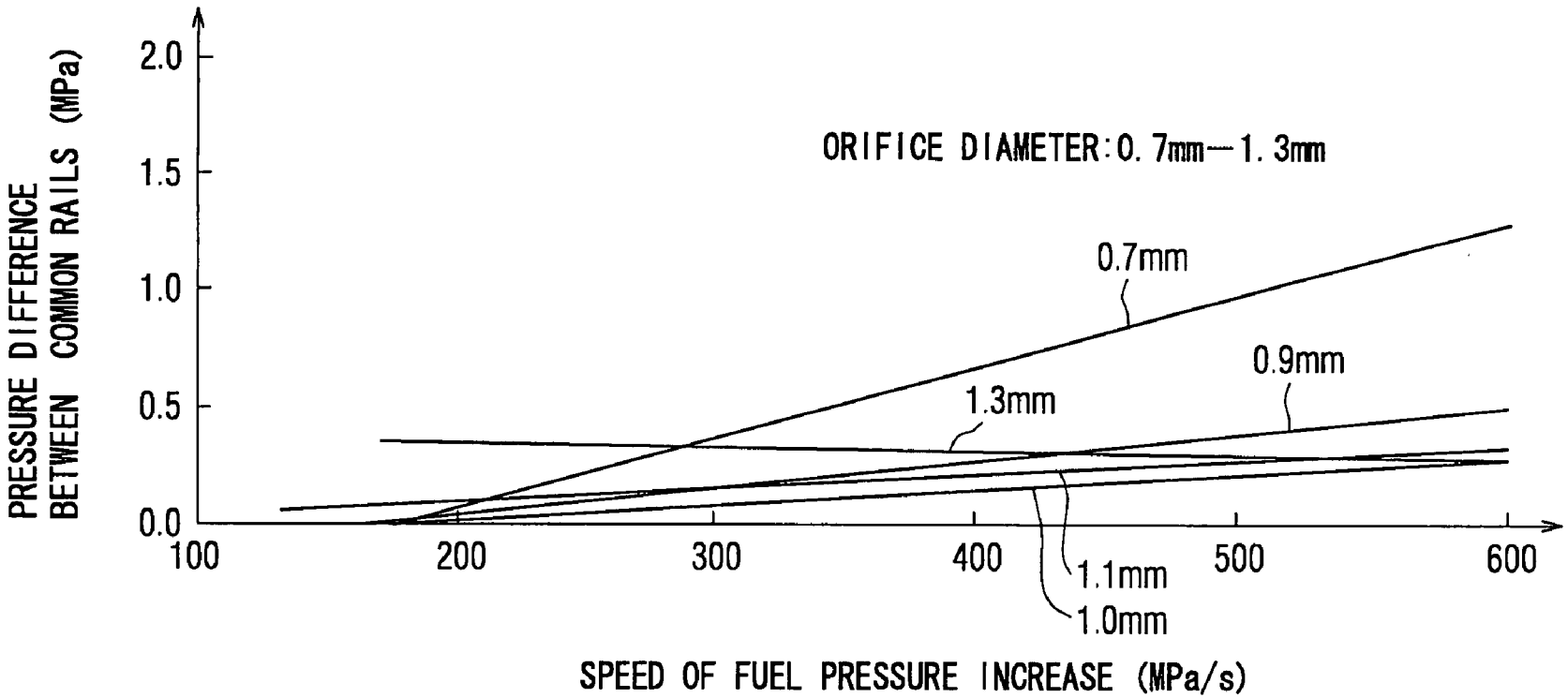
FIG. 2 is a graph showing a relation between pressure increase speed in a common rail and a pressure difference between two common rails.

To determine an appropriate size of the passage diameter in the orifice 13, experiments have been carried out. The results of the experiments are shown in FIG. 2, in which the pressure difference (in mega-Pascal) is shown on ordinate and a speed of fuel pressure increase (in mega-Pascal/second) is shown on abscissa. The experiments are carried out to find out an appropriate passage diameter in the orifice 13 that corresponds to a 3-litter to 5-litter engine having a maximum power of 140 kW to 240 kW.

As seen in FIG. 2, when the passage diameter in the orifice 13 is 0.9 mm, the pressure difference between the first and second common rails 4, 5 slightly increases according to increase in the speed of fuel pressure increase. When the passage diameter is 0.7 mm, the pressure difference considerably increases according to the increase in the speed of fuel pressure increase. This means that it is preferable to make the passage diameter larger than (or at least equal to) 0.9 mm. When the passage diameter is 1.0 mm, the increase in the speed of fuel pressure increase gives a very small influence on the pressure difference. This means that it is more preferable to make the passage diameter larger than or equal to) 1.0 mm.

On the other hand, if the passage diameter in the orifice 13 is too large, propagation of the pressure wave cannot be properly suppressed by the orifice 13, and the pressure wave cannot be properly attenuated by the orifice 13. As seen in FIG. 2, when the passage diameter is 1.3 mm, the pressure difference slightly increases according to decrease in the speed of fuel pressure increase. It is found out that the pressure difference becomes larger as the passage diameter becomes larger, exceeding 1.3 mm though this is not shown in FIG. 2. This means that it is preferable to make the passage diameter of the orifice 13 smaller than (or equal to) 1.3 mm. It is also seen that the pressure difference is further smaller when the passage diameter is 1.1 mm. This means that it is more preferable to make the passage diameter smaller than (or equal to) 1.1 mm. It is also confirmed that the preferable size or more preferable size of the passage diameter does not depend on the engine volume as long as the engine volume is in a range from 3-litter to 5-litter.

Figure 3A:
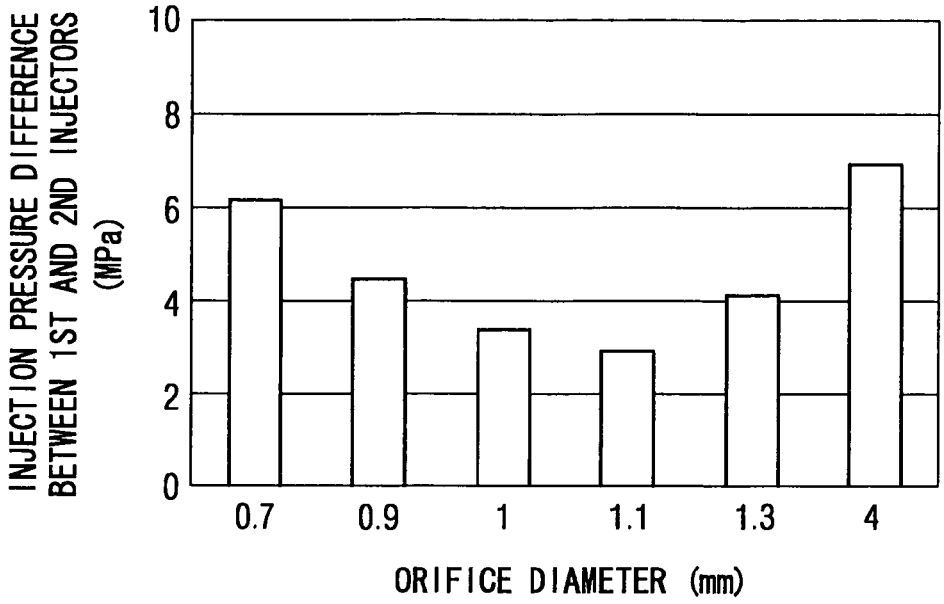
FIG. 3A is a graph showing an injection pressure difference between first injectors and second injectors relative to passage diameters of an orifice.
Figure 3B:
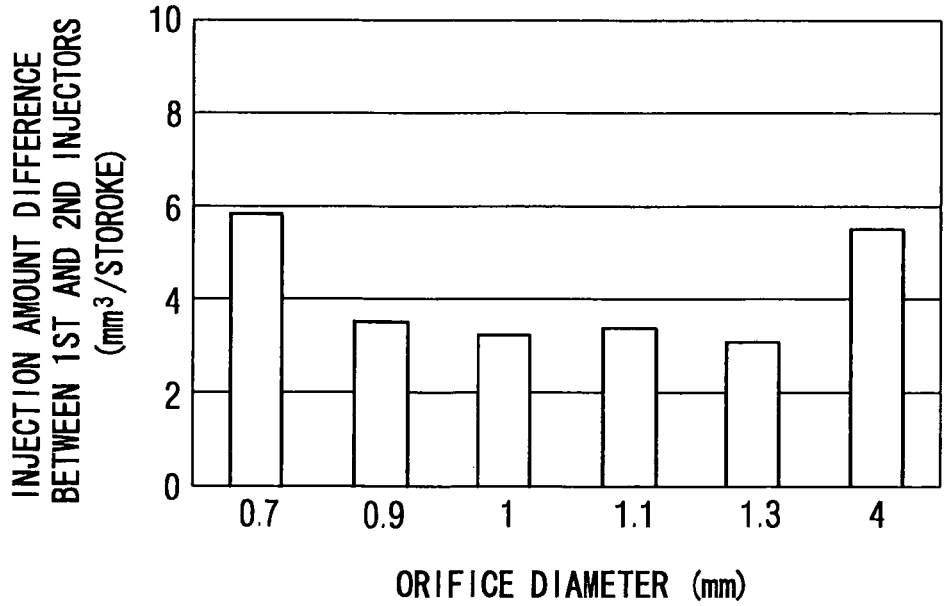
FIG. 3B is a graph showing an injection amount difference between the first injectors and the second injectors relative to the passage diameters of the orifice.

From the experiment results, it is concluded that a preferable size of the passage diameter of the orifice 13 is 0.9 mm–1.3 mm, and a more preferable size is 1.0 mm–1.1 mm. This is further confirmed in the following experiments shown in FIGS. 3A and 3B. In FIG. 3A, an injection pressure difference between a first injector 1 and a second injector 2 is shown on the ordinate (in mega-Pascal), and the passage diameter (in mm) of the orifice 13 (referred to as an orifice diameter) is shown on the abscissa. The injection pressure difference is measured under a normal operation of the engine. In FIG. 3B, an injection amount difference between the first injector 1 and the second injector 2 is shown on the ordinate, and the orifice diameter is shown on the abscissa. From both FIGS. 3A and 3B, it is clear that the injection pressure difference and the injection amount difference are minimized by making the orifice diameter 1.0–1.1 mm, and they can be reasonably small by making the orifice diameter 0.9–1.3 mm.

The following advantages are attained in the first embodiment described above. By making the orifice diameter smaller than 1.3 mm (more preferably smaller than 1.1 mm), propagation of the pressure wave in the connecting passage 12 is suppressed, and thereby the pressure difference between the first and the second common rails 4, 5 is made small. By making the orifice diameter larger than 0.9 mm (more preferably larger than 1.0 mm), a flow resistance in the connecting passage 12 is made low, and thereby the increase in the pressure difference between two common rails 4, 5 according to increase in the speed of fuel pressure increase is suppressed. That is, the injection pressure difference and the injection amount difference between the first injector 1 and the second injector 2 can be made considerably small by making the orifice diameter 0.9–1.3 mm (more preferably 1.0–1.1 mm). This is realized without using the distributing block J2 which has been used in the conventional fuel injection device. By eliminating the distributing block, the injection device can be manufactured at a low cost, and more over, it can be easily mounted on the engine.

In the first embodiment shown in FIG. 1, the orifice 13 is attached to each one of the common rails 4, 5. It is not necessary to use two orifices 13, but only one orifice 13 may be attached to one of the common rails 4, 5. Almost no difference is found between devices using one orifice or two orifices. The orifice 13 is integrally formed with the common rail 4, 5, thus reducing the number of components. When two orifices 13 are used, the common rails 4, 5 having the almost same structure (except that the first common rail 4 has the connecting port 14 to be connected to the fuel supply pump 3) can be used. This contributes to reduction in the manufacturing cost.

Figure 4:
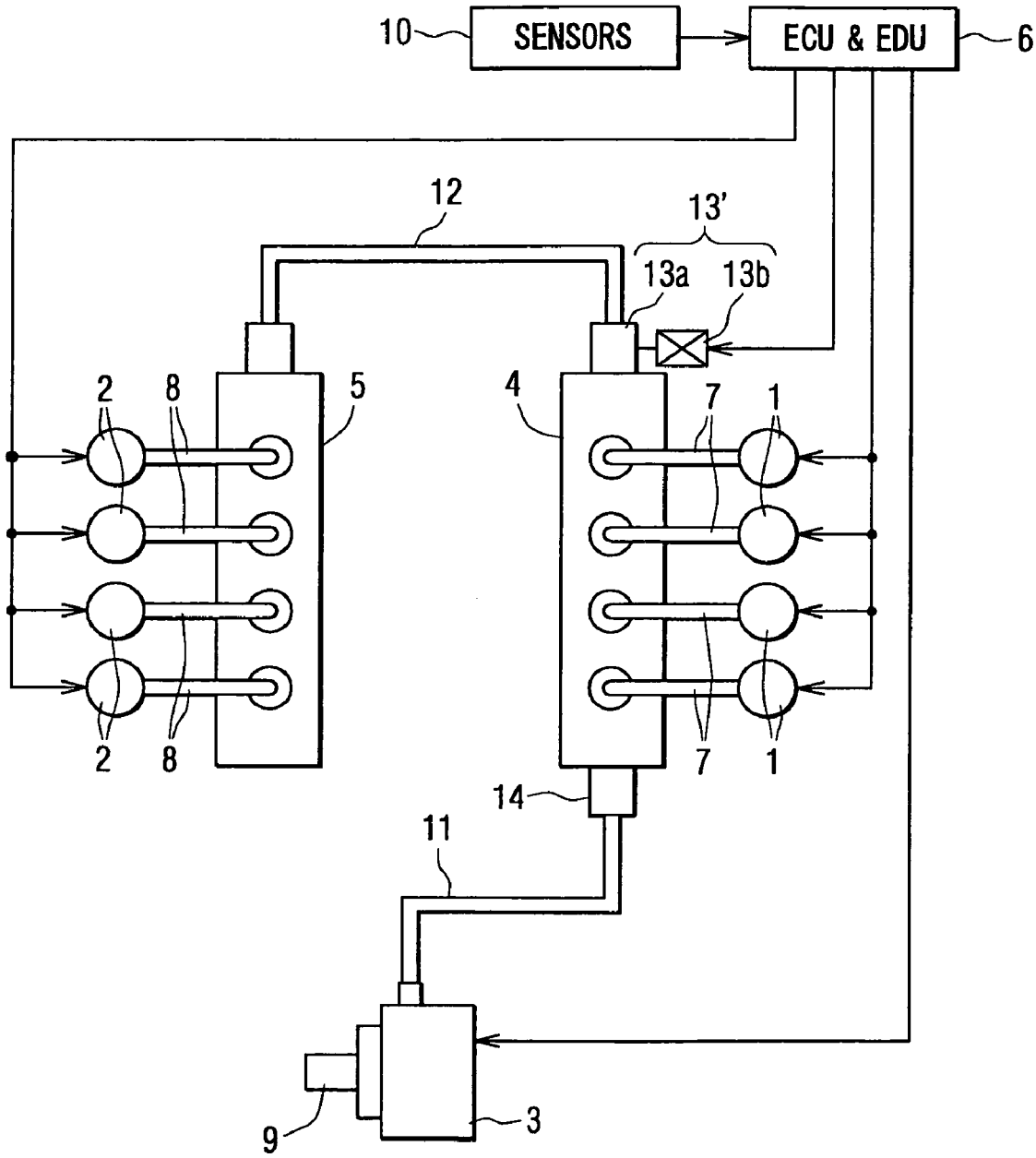
FIG. 4 is a block diagram briefly showing a common-rail-type fuel injection device as a second embodiment of the present invention.
Figure 5:
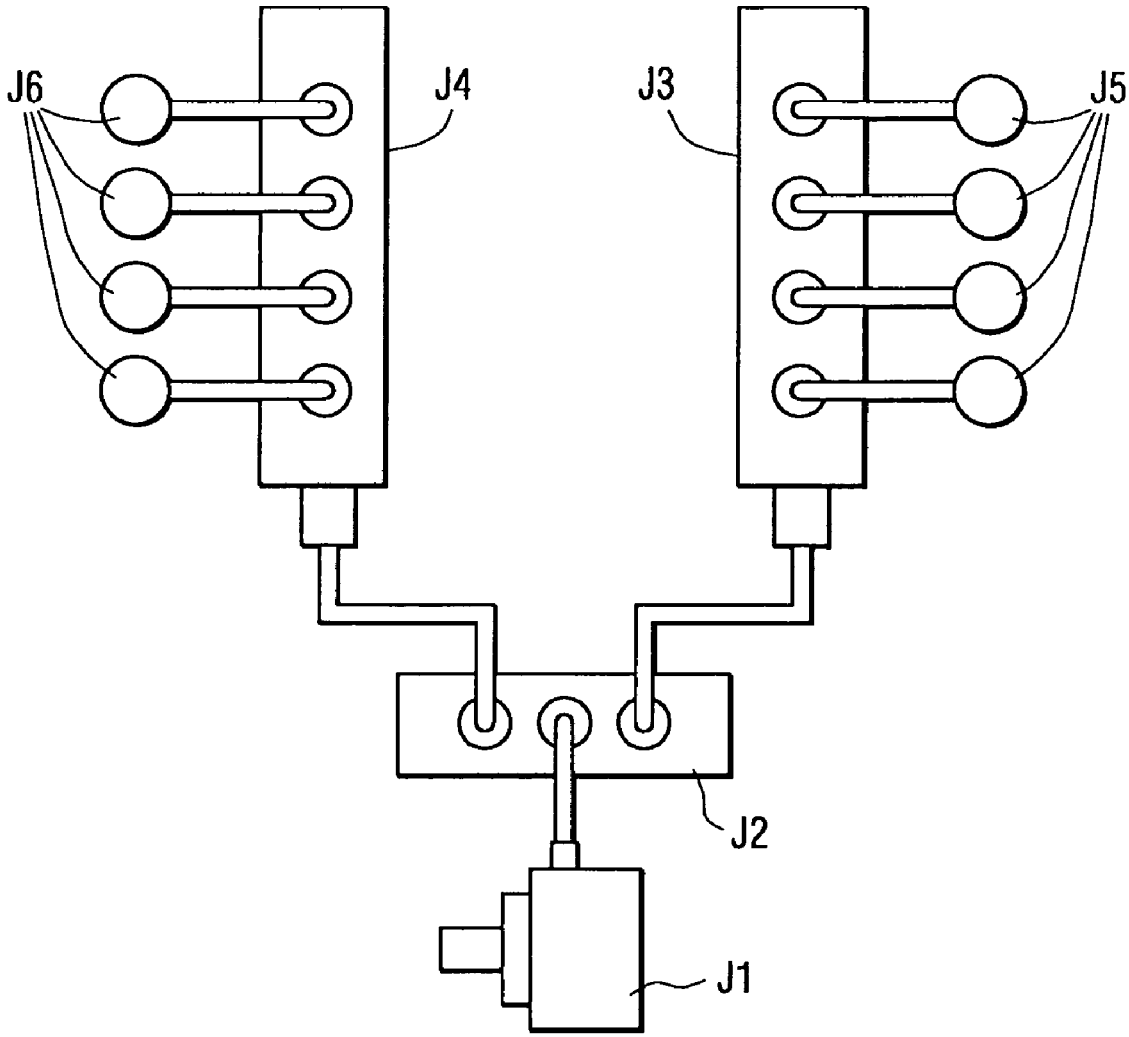
FIG. 5 PRIOR ART
FIG. 5 is a block diagram briefly showing a conventional common-rail-type fuel injection device.

A second embodiment of the present invention will be described with reference to FIG. 4. In this second embodiment, an orifice 13' composed of a valve 13*a* having a variable passage diameter and an actuator 13*b* for changing the variable passage diameter is used in place of the orifice 13. Other structures are the same as those of the first embodiment. Though the orifice 13' is connected to the first common rail 4 in the second embodiment shown in FIG. 4, it may be connected to the second common rail 5, or may be disposed in the connecting passage 12.

The actuator 13*b* may be an electromagnetic actuator or a piezoelectric actuator, which continuously or stepwise varies the passage diameter of the valve 13*a*. The actuator 13*b* is controlled by the controller 6 based on operating conditions of the engine. More particularly, the passage diameter of the valve 13*a* may be gradually changed from 0.9 mm to 1.3 mm according to the increase in the speed of fuel pressure increase. In this manner, the pressure difference between the first common rail 4 and the second common rail 5 can be kept very small not withstanding changes in the speed of fuel pressure increase. It is also possible to provide a valve 13 having two passage diameters in different sizes, and to switch one diameter to the other diameter according to the operational conditions of the engine. For example, the valve 13*a* is switched from the smaller passage diameter to the larger one when the fuel pressure increase speed exceeds a predetermined level. In this case, the actuator may operate in an on-off fashion. Actuators other than the electromagnetic or the piezoelectric actuator, such as a vacuum pressure actuator, may be used.

The optimum passage diameter of the orifice 13 is determined to correspond to the engine having a volume of 3–5 litters. For the engines other than the above, it is preferable to determine the optimum diameter so that it is substantially proportional to the engine volume and the engine output.

While the present invention has been shown and described with reference to the foregoing preferred embodiments, it will be apparent to those skilled in the art that changes in form and detail may be made therein without departing from the scope of the invention as defined in the appended claims.

What is claimed is:

1. A common-rail-type fuel injection device for supplying fuel to an internal combustion engine comprising:

first injectors mounted on a first cylinder block having a plurality of first cylinders, each first injector supplying high-pressure fuel to each first cylinder;

second injectors mounted on a second cylinder block having a plurality of second cylinders, each second injector supplying high-pressure fuel to each second cylinder;

a fuel supply pump for supplying high-pressure fuel;

a first common rail for accumulating the high-pressure fuel supplied from the fuel supply pump and for supplying the accumulated high-pressure fuel to the first injectors; and a second common rail for accumulating the high-pressure fuel supplied from the fuel supply pump and for supplying the accumulated high-pressure fuel to the second injectors, wherein:

the first common rail and the second common rail are connected in series through a first orifice, a connecting passage and a second orifice, the first orifice being integrally formed with the first common rail at a position where the connecting passage is connected to the first common rail and the second orifice being integrally formed with the second common rail at a position where the connecting passage is connected to the second common rail; and the high-pressure fuel is directly supplied to the first common rail from the fuel supply pump and to the second common rail from the first common rail through the first orifice, the connecting passage and the second orifice.

2. The common-rail-type fuel injection device as in claim 1, wherein:

each of the first orifice and the second orifice has a passage diameter in a range from 0.9 mm to 1.3 mm.

3. The common-rail-type fuel injection device as in claim 1, wherein:

the first orifice is composed of a valve having a variable passage diameter and an actuator for driving the valve; and the variable passage diameter is varied according to operating conditions of the internal combustion engine.

4. The common-rail-type fuel injection device as in claim 3, wherein:

the actuator is either an electromagnetic actuator or a piezoelectric actuator.

5. The common-rail-type fuel injection device as in claim 2, wherein:

each of the first orifice and the second orifice has a passage diameter in a range from 1.0 mm to 1.1 mm.

6. A common-rail-type fuel injection device for supplying fuel to an internal combustion engine comprising:

first injectors mounted on a first cylinder block having a plurality of first cylinders, each first injector supplying high-pressure fuel to each first cylinder;

second injectors mounted on a second cylinder block having a plurality of second cylinders, each second injector supplying high-pressure fuel to each second cylinder;

a fuel supply pump for supplying high-pressure fuel;

a first common rail for accumulating the high-pressure fuel supplied from the fuel supply pump and for supplying the accumulated high-pressure fuel to the first injectors; and a second common rail for accumulating the high-pressure fuel supplied from the fuel supply pump and for supplying the accumulated high-pressure fuel to the second injectors, wherein:

the first common rail and the second common rail are connected in series through a connecting passage;

the high-pressure fuel is directly supplied to the first common rail from the fuel supply pump and to the second common rail from the first common rail through the connecting passage;

an orifice is disposed in the connecting passage;

the orifice is composed of a valve having a variable passage diameter and an actuator for driving the valve; and the variable passage diameter is varied according to operating conditions of the internal combustion engine.

7. The common-rail-type fuel injection device as in claim 6, wherein:

the orifice actuator is either an electromagnetic actuator or a piezoelectric actuator.

8. The common-rail-type fuel injection device as in claim 6, wherein:

the orifice has a passage diameter in a range from 0.9 mm to 1.3 mm.

9. The common-rail-type fuel injection device as in claim 6, wherein:

the orifice is integrally formed with either the first common rail or the second common rail at a position where the connecting passage is connected to the common rail.

10. The common-rail-type fuel injection device as in claim 8, wherein:

the orifice has a passage diameter in a range from 1.0 mm to 1.1 mm.

* * * * *